United States Patent [19]

Mestler

[11] Patent Number: 4,560,135

[45] Date of Patent: Dec. 24, 1985

[54] CONVERTIBLE TABLE SUPPORT

[76] Inventor: Donald C. Mestler, 5 Potter Ct., Smithtown, N.Y. 11787

[21] Appl. No.: 636,305

[22] Filed: Jul. 31, 1984

[51] Int. Cl.[4] ..... F16M 13/00

[52] U.S. Cl. ..... 248/558; 108/19; 108/150; 248/188.7; 248/432

[58] Field of Search ..... 248/558, 188.6, 188.7, 248/188.8, 188, 188.1, 158, 432, 166, 169, 171, 165; 108/128, 150, 12, 19

[56] References Cited

U.S. PATENT DOCUMENTS

| | | | |
|---|---|---|---|
| 2,238,708 | 4/1941 | Russell . | |
| 3,232,584 | 2/1966 | Miles | 248/166 |
| 3;391,660 | 7/1968 | Stewart . | |
| 3,473,771 | 10/1969 | Newman . | |
| 3,738,699 | 12/1973 | Fain . | |
| 3,838,838 | 10/1974 | Seaman, Jr. . | |
| 4,061,302 | 12/1977 | Boone . | |
| 4,074,881 | 2/1978 | Bickford . | |
| 4,223,860 | 9/1980 | Prest . | |

FOREIGN PATENT DOCUMENTS

| | | | |
|---|---|---|---|
| 564295 | 2/1958 | Belgium | 108/150 |
| 34243 | 11/1969 | German Democratic Rep. | 248/188 |
| 915595 | 1/1963 | United Kingdom | 248/188.7 |

*Primary Examiner*—J. Franklin Foss
*Assistant Examiner*—David L. Talbott
*Attorney, Agent, or Firm*—Brumbaugh, Graves, Donohue & Raymond

[57] ABSTRACT

A support apparatus is arranged for use with a van or camper table, wherein a table top is mounted by a cylindrical table support tube to the floor of a van or similar vehicle using sockets mounted on the underside of the table top and the floor of the vehicle which receive tapered ends of a central cylindrical support tube. The support apparatus includes a collar, which engages the support tube, and legs which extend from the collar. With the support apparatus attached, the support tube can be mounted with the support apparatus at the bottom, so that the table can be used on a ordinary horizontal surface, or with the support apparatus at the top, immediately below the table top, so that the tube can support the table top inside a vehicle by engagement of the tapered end to a received socket mounted to the vehicle.

5 Claims, 3 Drawing Figures

CONVERTIBLE TABLE SUPPORT

BACKGROUND OF THE INVENTION

This invention relates to table support apparatus, and particularly apparatus useable in connection with a table of the type often used in recreational vehicles, vans, boats and the like.

Vehicle tables are usually provided with a detachable table top and a central cylindrical tube which provides support for the vehicle table. The central tube has two tapered ends which can be received in correspondingly tapered sockets which are mounted to the bottom of the table top and to the floor of the vehicle.

An object of the present invention is to provide a table support apparatus to enable the use of a camper or similar vehicle table outside of the vehicle, as for example, for picnicking.

A further object of the invention is to provide a support apparatus which can be conveniently stored when not in use.

SUMMARY OF THE INVENTION

In accordance with the present invention there is provided a support apparatus for use with a table arrangement which includes a table top having a tapered receiving socket mounted on one side and a cylindrical table support tube having tapered ends for insertion into the table top socket and another socket. The support apparatus includes a cylindrical collar having an axis and a central axial bore arranged to surround the tube. The collar has means for engaging the tube to axially fix the collar on the tube. The collar has first and second axial ends. Support means are attached to and extend radially and axially from the collar. The support means extends axially from one of the axial ends of the collar by a distance that exceeds the axial length of the receiving socket and extends radially from the collar by a distance that exceeds the radial size of the receiving socket to provide stable free-standing support for the tube. The support apparatus has a concave open area bounded by the collar and the support means, which is larger than the receiving socket. Accordingly, when the support apparatus is axially fixed to the table support tube a selected distance from one end, with the support means extending axially beyond the one end by a selected amount, the one end may be received in the table top receiving socket without the support means interfering with the table top.

In a preferred embodiment of the invention the support means comprises at least three legs which extend tangentially from the collar and are fixed to the collar. The tube engaging means is a set screw mounted in a radially threaded bore on the collar. The support apparatus can be combined with a conventional cylindrical table support tube with tapered ends to form a dual purpose table support. The dual purpose table support may be mounted with the support apparatus end down for supporting the table on a conventional horizontal surface, or with the support apparatus end up under the table top, for mounting the table in a camper or similar vehicle.

For a better understanding of the present invention, together with other and further objects, reference is made to the following description, taken in conjunction with the accompanying drawings, and its scope will be pointed out in the appended claims.

DESCRIPTION OF THE INVENTION

Figure 1:
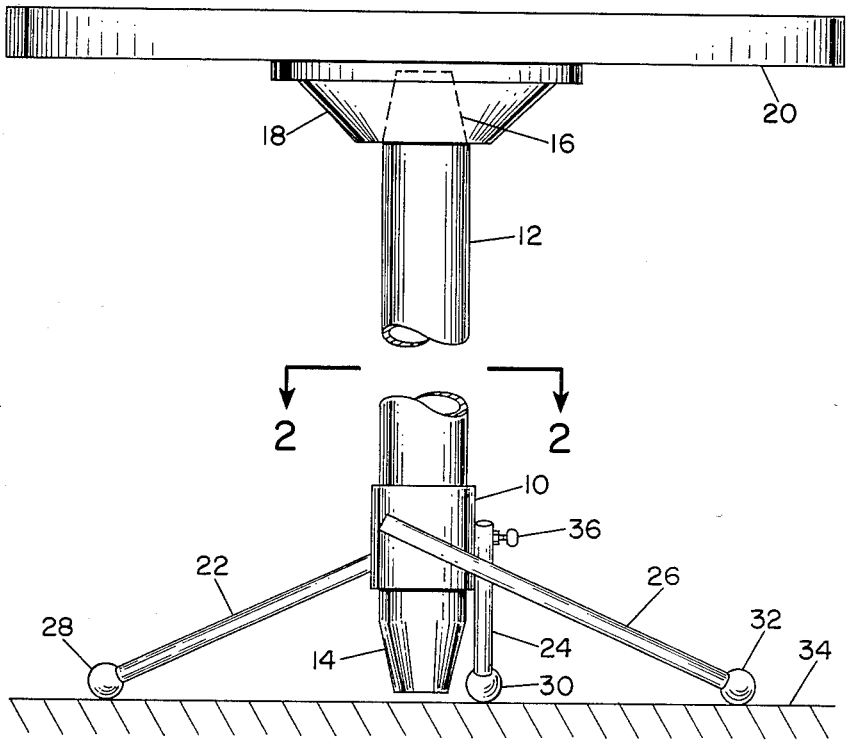
FIG. 1 is a plan elevation view of a table with a support apparatus in accordance with the present invention.
Figure 2:
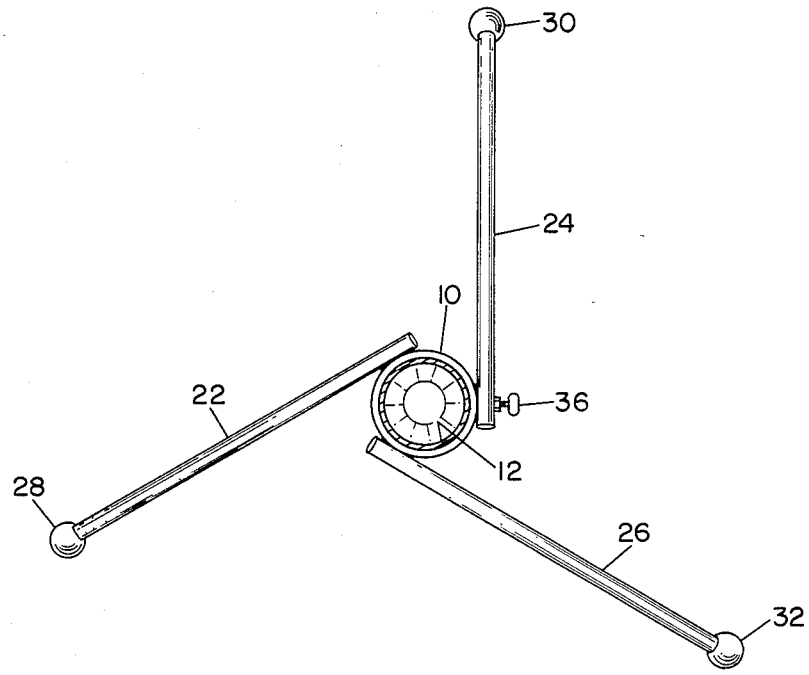
FIG. 2 is a cross-sectional view of the table of FIG. 1.

Referring to FIGS. 1 and 2 there is shown a support apparatus mounted to a conventional camper table. The support apparatus includes a collar 10 which surrounds a table support tube 12. Support tube 12 is of standard and conventional design and consists of a tube, which is usually chrome plated and has an outside diameter of $2\frac{1}{4}$ inches. Tube 12 has a tapered first end 14 and second end 16. In the standard support tube these ends are identical and arranged to fit into sockets, such as socket 18, which is mounted to the bottom of table top 20. Many recreational vehicles, such as vans, have similar sockets mounted to the vehicle floor, for receiving an end of tube 12. Some variations exists, such as sockets which are flush mounted within a vehicle floor for receiving an end of tube 12. Also, a table top which is double thickness to provide storage space below the upper surface may have a socket recessed within the thickness of the table top.

The support apparatus of the present invention includes a collar 10, which is cylindrical in shape and has a central axial bore arranged to receive tube 12. Extending from collar 10 in the embodiment shown in FIGS. 1 and 2 are three support legs 22, 24 and 26. These are arranged with equal angular spacing around the periphery of collar 10 and are rigidly secured to collar 10, such as, for example, by welding. In the embodiment shown in FIG. 1 support legs 22, 24 and 26 are made of steel conduit tubing, which is approximately $\frac{1}{2}$ inch inside diameter and 0.7 inch outside diameter. Each leg has a length of approximately 12 inches and extends axially approximately 3.75 inches from its point of attachment to collar 10. The legs extend 2.25 inches beyond the lower axial end of collar 10 as shown in FIG. 1. At the end of each of legs 22, 24 and 26 there are provided rubber tips 28, 30 and 32, to prevent damaging either the legs or a surface 34 on which the table rests.

Figure 3:
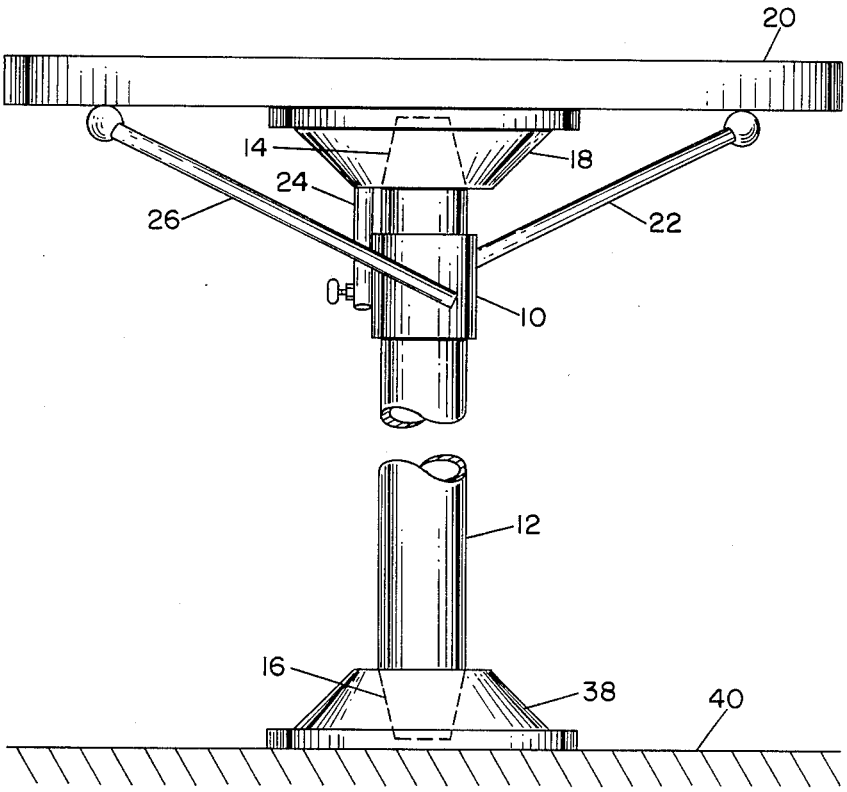
FIG. 3 is a plan elevational view of the FIG. 1 apparatus with the table support in the stored position.

An important aspect of the present invention is the arrangement of legs 22, 24 and 26 and collar 10 to enable the end 14 of the support tube 12 to be inserted into a receiving socket 18 on the underside of a table as shown in FIG. 3. Accordingly, legs 22, 24 and 26 extend both radially and axially from collar 10 and extend axially a distance from the lower axial end of collar 10 which is greater than the length of the tapered end 14 (approximately 1.5 inches) and the standard receiving socket 18 (approximately 1.75 inches). The axial extension of legs 22, 24 and 26 beyond the lower axial end of collar 10 enable collar 10 to be selectively located at an axial location along tube 12 such that legs 22, 24 and 26 extend beyond the end of tube 12 to support the table as shown in FIG. 1, yet do not extend so far beyond the end of the tube 12 that they interfere with table top 20 when end 14 is inserted into socket 18 on table top 20 as shown in FIG. 3. In the illustrated embodiment the lower axial end of collar 10 in FIG. 1 is mounted approximately 2.125 inches from the lower end of tube 12 so that legs 22, 24, 26 extend 0.125 inches beyond the end of the tube.

As illustrated, legs 22, 24 and 26 also extend outwardly from collar 10 and thereby form a region of the support apparatus which is substantially a concave open area into which socket 10 can be received.

Those skilled in the art will recognized that the support apparatus of the present invention may alternately be provided with four or more legs which extend similarly to the legs shown in FIG. 1. All that is required is that the legs extend a sufficient radial distance from the support collar and an axial distance as specified above, so that there is no interference between the receiving socket 18 and the support means comprising the legs 22, 24 and 26. It will be recognized that one alternative may be a continuous, skirt like support means which extends both radially and axially from collar 10 in a bell shaped configuration.

A set screw 36 is provided for axially fixing collar 10 at the correct location along support tube 12. An important feature of the present invention is that the set screw need not be loosened during most ordinary usage of the present invention. Proper setting of the set screw axially along tube 12, as described above, enables the assembled tube and support apparatus to be mounted either with the support apparatus down, as shown in FIG. 1, for supporting a table outside the vehicle, or with the support apparatus up, as shown in FIG. 3, for supporting the table inside the vehicle and at the same time conveniently storing the support apparatus. In some table tops, wherein the socket 18 is recessed within the table top, it may be necessary to loosen set screw 36 in order to provide proper storage of the support apparatus, since in this case proper mounting of an end to the table top would require that the tapered portion 14 extend within the table top, in which case, the fixed legs 22 would interfere, if collar 10 were not axially moved on support 12.

While there has been described what is believed to be the preferred embodiment to the present invention, those skilled in the art will recognize that other and further modifications may be made thereto without departing from the spirit of the invention, and it is intended to claim all such embodiments as fall within the true scope of the invention.

I claim:

1. Support apparatus, for use with a table arrangement including a table top having a tapered receiving socket mounted on one side and a cylindrical table support tube having identical tapered ends for insertion into said table top socket and another socket, comprising a cylindrical collar having an axis and a central axial bore arranged to surround said tube, said collar having means for engaging said tube to axially fix said collar on said tube and having first and second axial ends, and support means attached to and extending radially and axially outward from said collar, said support means extending axially from one of said axial ends by a distance that exceeds the axial length of said receiving socket and extending radially from said collar by a distance that exceeds the radial size of said receiving socket to provide stable free-standing support for said tube, said support apparatus having a concave open area, bounded by said collar and said support means, which is larger than said receiving socket, whereby when said support apparatus is axially fixed to said table support tube a selected distance from one end, with said support means extending axially beyond said one end, said one end may be received in said receiving socket without said support means interfering with said table top.

2. Apparatus as specified in claim 1 wherein said supporting means comprises at least three legs.

3. Apparatus as specified in claim 2 wherein said legs extend tangentially from said collar.

4. Apparatus as specified in claim 3 wherein said tube engaging means is a set screw mounted in a radial threaded bore on said collar.

5. A dual purpose table support comprising a cylindrical table support tube having identical tapered ends for insertion into tapered receiving sockets mounted on flat surfaces and a support apparatus mounted in an axially fixed position on said tube, said support apparatus having a collar surrounding said tube and spaced from one end of said tube by a distance which exceeds the axial length of said socket and at least three legs extending from said collar, said legs extending axially from said collar by a distance which extends beyond said one end of said tube but not beyond said flat surface when said one end is received in a socket and extending radially from said collar by a distance sufficient to provide a free standing table support and surround said socket without interference.

* * * * *